United States Patent [19]

Ronnick

[11] Patent Number: 4,927,151

[45] Date of Patent: May 22, 1990

[54] GOLF CLUB INCLUDING SIGHT LEVEL INDICATOR

[76] Inventor: Albert J. Ronnick, 1928 S. Orange Ave., Sarasota, Fla. 34239

[21] Appl. No.: 387,000

[22] Filed: Jul. 28, 1989

[51] Int. Cl.[5] ..... A63B 69/36; A63B 53/00

[52] U.S. Cl. ..... 273/162 B; 273/32 H

[58] Field of Search ..... 273/162 B, 32 B, 32 R, 273/162 R, 163 R, 163 A, 164, 183 D, 186 A, 193 R, 194 R, 32 H, 32 B, 32 R; 33/370, 508

[56] References Cited

U.S. PATENT DOCUMENTS

| | | | |
|---|---|---|---|
| 2,204,974 | 6/1940 | Strasser | 273/162 B |
| 2,919,491 | 1/1960 | Darrell et al. | 273/162 B |
| 3,182,401 | 5/1965 | Stevens | 273/162 B |
| 3,242,582 | 3/1966 | Garrett | 273/162 B |

*Primary Examiner*—George J. Marlo

*Attorney, Agent, or Firm*—Charles J. Prescott

[57] ABSTRACT

A sight level indicator for golf clubs connectable into a mating slot or groove formed into the golf club handle adjacent its upper end. The invention includes a liquid-filled, transparent vial having an elongated, preferably cylindrical body, the liquid forming a viewable gas bubble within the vial as indicium of true horizontal orientation of the vial. The slot or groove is formed transversely into the handle and perpendicular to the longtitudinal axis of the golf club such that, when the gas filled bubble within the vial indicates a true horizontal orientation of the vial, the golf club is visually perpendicular to the ground. The various embodiments provide for minimizing the felt discontinuity in the handly surface grasping area while still insuring quick and accurate viewability of the invention in use. The invention may also be provided as a completed golf club assembly.

4 Claims, 1 Drawing Sheet

GOLF CLUB INCLUDING SIGHT LEVEL INDICATOR

BACKGROUND OF THE INVENTION

This invention relates generally to golf clubs, and more particularly to a sight level indicator which facilitates using a golf club as an upright reference.

Using the slender golf club handle and shaft as a viewable vertical reference is probably as old as the game of golf itself. In many instances the golfer finds himself/herself on a course or putting green which has an uneven and non-level turf or grade and quickly looses a sense of "which way is up". This is particularly critical during putting or chipping where the green is slightly askew from horizontal and perhaps rolling downwardly in both lateral directions along a sight line between the resting place of the golf ball and the cup.

However, when using a golf club alone, the user is never quite sure that he is holding the club in an upright position. This is due to the fact that finger pressure must be exerted at the upper end of the handle to support the golf club like a pendulum which may put some amount of rotational force into the club to counteract the force of gravity. Additionally, many golf club heads, particularly putting golf clubs, are not symmetrical about the longitudinal axis of the golf club shaft, resulting in an offset center of gravity which induces some slight offset of the club shaft from true vertical even if perfectly supported at its upper end.

A number of prior art devices are known to applicant which provide some viewable means for improving the game of golf. The following group of issued U.S. patents are directed to devices which are attachable to the shaft of a golf club at or near the handle end of the club:

| | |
|---|---|
| 2,204,974 | R. Strasser |
| 3,182,401 | W. E. Stevens |
| 3,242,582 | C. L. Garrett |
| 4,079,520 | C. B. Davis |
| 4,114,886 | B. C. Koch |
| 4,179,125 | Cone, et al. |
| 4,482,155 | R. H. Higley |

A second group of prior art devices, somewhat further removed from that of the present invention, is directed devices which are attachable and/or incorporated into the golf head itself as follows:

| | |
|---|---|
| 3,306,618 | J. L. Liljequist |
| 3,429,576 | Yoshiaki Ikeda |
| 3,909,004 | Vella |
| 4,082,286 | F. J. LaBreche |
| 4,575,090 | B. E. Heseltine |
| 4,580,350 | F. T. Fincher |
| 4,824,114 | G. G. Catalano |

However, none of the above prior art devices accomplish the desired function of quickly orienting a golf club to a truly upright position for sighting to establish the direction of offset of the fairway or putting green grade. Many of the above devices perform entirely different functions that than of the present invention.

BRIEF SUMMARY OF THE INVENTION

This invention is directed to a sight level indicator for golf clubs connectable into a mating slot or groove formed into the golf club handle adjacent its upper end. The invention includes a liquid-filled, transparent vial having an elongated, preferably cylindrical body, the liquid forming a viewable gas bubble within the vial as indicium of true horizontal orientation of the vial. The slot or groove is formed transversely into the handle and perpendicular to the longitudinal axis of the golf club such that, when the gas filled bubble within the vial indicates a true horizontal orientation of the vial, the golf club is visually perpendicular to the ground. The various embodiments provide for minimizing the felt discontinuity in the handle surface grasping area while still insuring quick and accurate viewability of the invention in use. The invention may also be provided as a completed golf club assembly.

It is therefore an object of this invention to provide an easily installable and economical sight level indicator connectable adjacent the upper end of the handle of a golf club for accurately establishing a true vertical reference against the offset grade of a golf fairway or putting green.

It is yet another object of this invention to provide a sight level indicator which is readily accessible for use and yet is unobtrusive to the user's feel and touch during normal use of the golf club.

It is another object to provide the above invention incorporated into currently manufactured golf clubs.

In accordance with these and other objects which will become apparent hereinafter, the instant invention will now be described with reference to the accompanying drawings in which:

BRIEF DESCRIPTION THE DRAWINGS

DETAILED DESCRIPTION OF THE INVENTION

Figure 1:
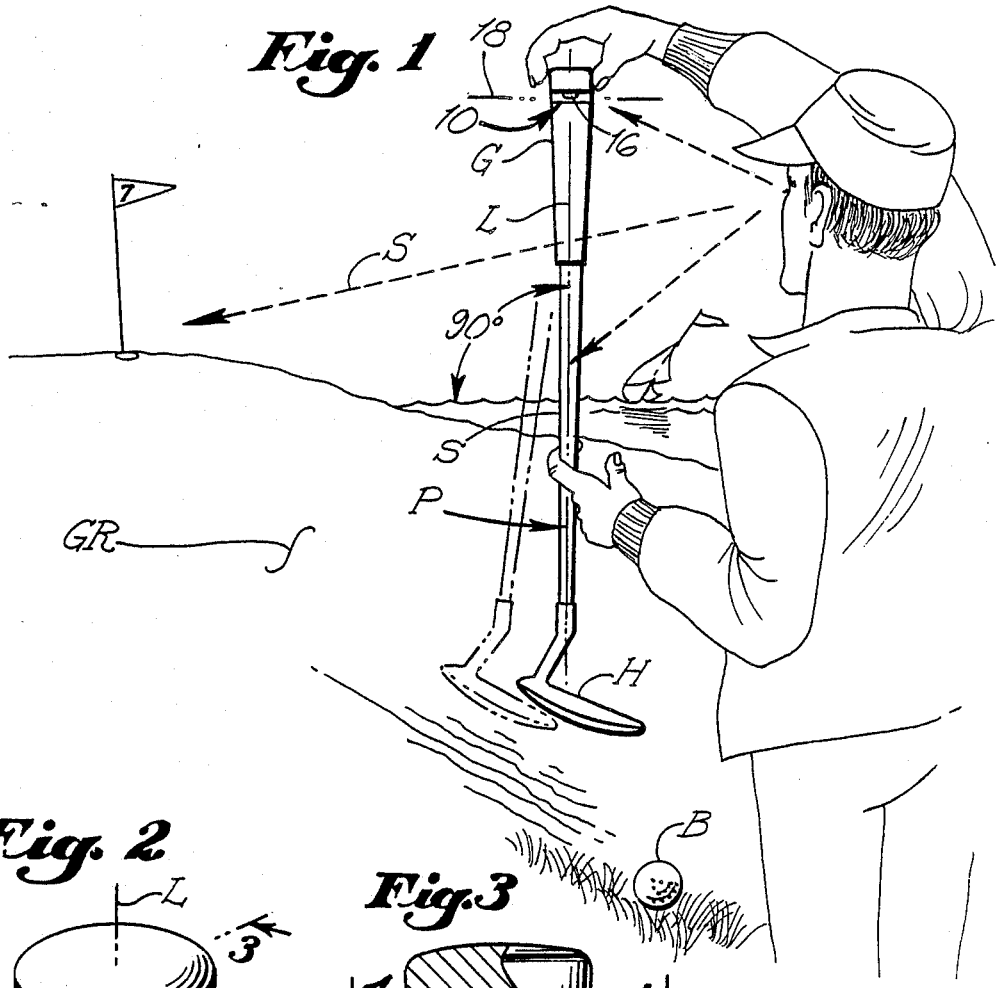
FIG. 1 is a pictorial view of the preferred embodiment of the invention in use.

It is here noted that the invention may be provided in the form of a sight level indicator in its various embodiments herebelow described which may be readily incorporated into an existing golf club and, alternately, as an article of manufacture in the form of a golf club having the sight level indicator of the present invention installed thereinto during manufacture. Thus, the detailed description herebelow will be directed to describing the invention in conjunction with a golf club with this understanding in mind.

Referring to the drawings, and particularly to FIGS. 1 to 4, the preferred embodiment of the sight level indicator is generally shown at numeral 10. This sight indicator 10 includes an elongated, cylindrical vial 12 about axis 18 and having a quantity of liquid 14 contained therein. The vial 12 is made of thin, transparent glass or plastic material and is sealed to completely contain the liquid 14. The quantity of liquid 14 sealed within vial 12 is such that a gas bubble 16 remains therein whereby when the longitudinal axis 18 of vial 12 is held in a horizontal position, the gas bubble 16 is centered along the length of the vial 12.

Figure 3:
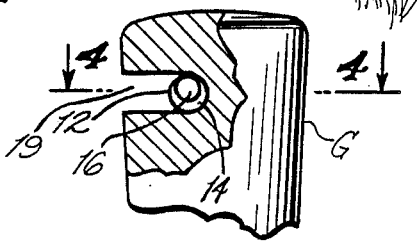
FIG. 3 is a broken section view in the direction of arrows 3—3 in FIG. 2.
Figure 4:
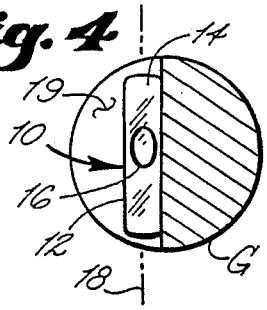
FIG. 4 is a section view in the direction of arrows 4—4 in FIG. 3.

A notch or groove 19 has been prepared in the handle G of golf club P. This notch 19 is accurately established to be transverse to the longitudinal axis L and structured to receive the sight level indicator 10 fully within the notch 19 such that the ends of vial 12 are just within the outer profile or perimeter surface of the handle G. This sizing is important so as to minimize any disruptive contact of the user's hands during normal use of the golf club. Although the notch 19 is transversely cut directly into handle G, thus leaving an unfilled outer portion of notch 19 as best seen in FIG. 3, applicant has determined that this unfilled portion of notch 19 is not objectionable, in part because of the location and positioning of the notch 19 immediately adjacent the upper end of the handle G as shown.

Figure 2:
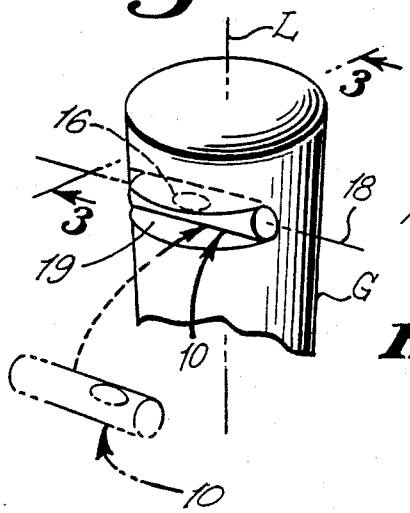
FIG. 2 is a perspective view of the upper end of the handle shown in FIG. 1.

Having carefully positioned notch 19 transversely as previously described, sight level indicator 10 is readily installable as depicted in FIG. 2 and held in place by a clear adhesive such as silicon rubber or the like. Thus, in use, the user may quickly support the golf club as shown in FIG. 1 or by grasping the golf club anywhere along the length of its shaft S or even by club head H so as to be able to observe the gas bubble 16. When the gas bubble 16 is viewably centered within vial 12, the longitudinal axis L of the shaft S is exactly upright and the user may then view the grade GR and its slope to the right or to the left in determining the ultimate direction that he wishes to strike the golf ball B.

Figure 5:
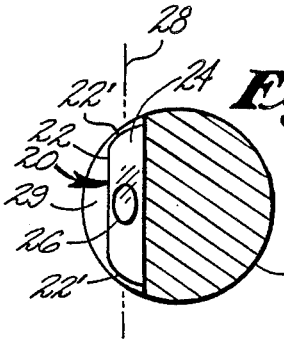
FIG. 5 is a section view similar to FIG. 4 showing an alternate embodiment of the invention.

Referring to FIG. 5, an alternate embodiment of the invention including a generally cylindrical vial 22 having liquid 24 and gas bubble 26 as previously described is shown generally at numeral 20. This embodiment envisions vial 22 about axis 28 being installed into a transversely cut notch 29 similar to that previously described except for the reduced depth thereof inwardly toward the center of the grip G. This reduction in overall depth of notch 29 is accomplished by diagonally disposing the ends 22' so as to more closely conform to the outer profile of the grip G in the region of installation. This end configuration at 22' of vial 22 further minimizes any discontinuity, providing normal feel of the grip G during play.

Figure 6:
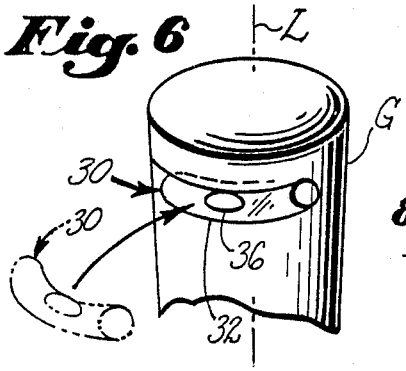
FIG. 6 is a perspective view of the golf club handle showing another embodiment of the invention.
Figure 7:
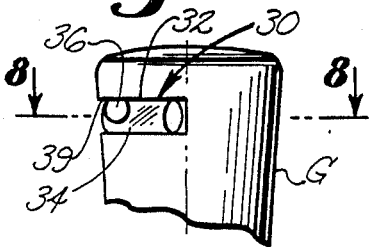
FIG. 7 is a right side elevation view of FIG. 6.
Figure 8:
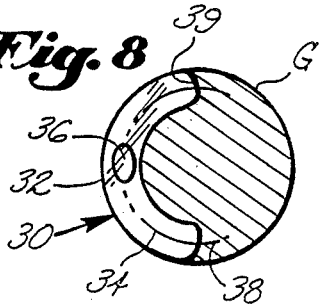
FIG. 8 is a section view in the direction of arrows 8—8 in FIG. 7.

Referring lastly to FIGS. 6, 7 and 8, another embodiment of the sight level indicator is shown generally at numeral 30. This embodiment 30 includes an arcuate vial 32 being filled with liquid 34 so as to produce gas bubble 36 within the sealed vial 32 as previously described. The arcuate shape of vial 32 is such that the outermost periphery thereof exactly conforms with the normally circular transverse profile of the golf club G at notch 39 as best seen in FIG. 8. The ends of vial 32 are generally uniform and may easily fit into mating notch 32 such that arcuate axis 38 is again perpendicular to the longitudinal axis L of golf club G. This last embodiment 30 virtually completely eliminates any discontinuity in grip G feel due to the installation of the sight level indicator 10 within notch 39.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A golf club including a sight level indicator, said golf club having an elongated shaft with a head at the lower end of said shaft and a handle at the upper end of said shaft, said level indicator comprising:

a liquid-filled transparent vial having an elongated body, said liquid in sufficient quantity within said vial to form a gas bubble within said vial for viewing;

said vial structured to be connected within a mating slot or groove formed adjacent the upper end, and extending inwardly from the outer surface, of the golf club handle, said slot or groove transverse and perpendicular to the longitudinal axis of the golf club;

said vial generally fitting within the outer surface of the golf club handle and oriented so that said bubble may be viewed when said shaft is suspended in a generally upright orientation by the golfer for establishing the direction of offset of the fairway or putting green grade.

2. A golf club including a sight level indicator as set forth in claim 1, wherein:

said vial is a straight indicator.

3. A golf club including a sight level indicator as set forth in claim 2, wherein:

said vial has contoured ends which are co-extensive with the adjacent outer surface of the golf club when said vial is connected into said slot or groove.

4. A golf club including a sight level indicator as set forth in claim 1, wherein:

said vial is arcuate having an outer most peripheral surface which is generally in close alignment with the adjacent outer surface of the golf club handle when said vial is connected into said slot or groove.

* * * * *